United States Patent [19]

Riblet

[11] 4,127,832

[45] Nov. 28, 1978

[54] DIRECTIONAL COUPLER

[76] Inventor: Gordon P. Riblet, 11 Michigan Dr., Natick, Mass. 01760

[21] Appl. No.: 781,683

[22] Filed: Mar. 28, 1977

Related U.S. Application Data

[63] Continuation-in-part of Ser. No. 766,431, Feb. 7, 1977.

[51] Int. Cl.[2] ..... H01P 5/18

[52] U.S. Cl. ..... 333/10; 333/33

[58] Field of Search ..... 333/10

[56] References Cited

U.S. PATENT DOCUMENTS

| | | | |
|---|---|---|---|
| 3,571,762 | 3/1971 | Smilen | 333/10 |
| 3,593,208 | 7/1971 | Smith | 333/10 |
| 3,772,616 | 11/1973 | Imoto | 333/10 X |
| 3,904,991 | 9/1975 | Ishii et al. | 333/10 |
| 4,023,123 | 5/1977 | Reindel | 333/10 |

*Primary Examiner*—Paul L. Gensler

*Attorney, Agent, or Firm*—Wolf, Greenfield & Sacks

[57] ABSTRACT

A compact four-port two branch coupler preferably constructed in stripline or microstrip media having an input port and a pair of output ports. The equivalent admittance of a coupler has a real part (conductance) and imaginary part (susceptance), and known design techniques require the branch line electrical length $\theta$ to be $\pi/2$ or 90°, so that the device is properly matched. However, to reduce the physical line lengths at a predetermined operating frequency in accordance with the invention the electrical length $\theta$ is chosen at a lower value of, for example, $\pi/4$ or 45° thereby reducing the line lengths of the branches making the device more compact. This choice now creates an inductive mismatch in the equivalent admittance which is easily compensated for by a capacitance at each junction in order to make the total susceptance zero so that the device is matched for $\theta = \pi/4$. This is accomplished quite effectively with the capacitive sections being conveniently located in the central open area formed between the four strip networks defining the coupler.

15 Claims, 5 Drawing Figures

DIRECTIONAL COUPLER

RELATED APPLICATION

This is a continuation-in-part application of Ser. No. 766,431 filed Feb. 7, 1977.

BACKGROUND OF THE INVENTION

The present invention relates in general to directional couplers and is concerned, more particularly, with a technique for constructing a more compact four port, two branch directional coupler by providing capacitive matching networks preferably at each port of the directional coupler.

FIG. 1 shows a prior art coupler network in stripline construction and substantially the same as the one referred to in my copending application Ser. No. 766,431. With the conventional coupler the physical line lengths 1 inversely relate to the operating frequency of the device. At the higher microwave frequencies there is no problem in that the line lengths are relatively short and the device can be made quite compactly. However, at the lower microwave frequencies the proportionately larger line lengths make the overall device quite large especially in comparison with the devices used at the higher frequencies.

Accordingly, an object of the present invention is to provide a directional coupler using distributed elements that can be constructed more compactly than prior art couplers and especially so when constructed for operation at lower microwave frequencies or UHF frequencies.

A further object of the present invention is to provide a compact branch coupler that is preferably constructed in stripline, and that can be fabricated quite easily in a compact form.

SUMMARY OF THE INVENTION

To accomplish the foregoing and other objects of this invention, there is provided a branch line directional coupler which is comprised of two pairs of two-port networks, each two-port network connected at its' ports to one of the ports of each of the other pair of two-port networks to form the basic four ports of the coupler. One of the ports of the coupler may be identified as a signal input port while two other ports of the coupler may be identified as signal output ports. Actually, any port of the coupler can be used as the input port. In the preferred construction each network is in the form of a section of transmission line and the entire device is of stripline construction. In accordance with the present invention, for a predetermined operating frequency, the physical line lengths of the networks are reduced in comparison with the line lengths physically used with known devices making the device more compact but in turn creating an inductive mismatch in the equivalent admittance which is compensated for by the use of a capacitive matching network connected to each port of the coupler.

The equivalent admittance of a coupler is known to have a real part (conductance) and an imaginary part (susceptance) and known design techniques require the branch line electrical length $\theta$ to be 90°, so that the device is properly matched. However, in accordance with the design procedure of the present invention the physical line lengths at a predetermined operating frequency are reduced by selecting a lower value of the electrical length $\theta$. Selection of this reduced value of $\theta$ which may be on the order of 45°, however, creates an inductive mismatch in the equivalent admittance which is compensated for by the capacitive matching network at each port or junction of the coupler to make the total susceptance zero so that the device is matched for $\theta$ = 45°. The capacitive matching networks may be very conveniently located in the central open area formed between the four strip transmission line sections defining the coupler. In an alternate embodiment where it is desireable to make the device larger for ease in holding tolerances, $\theta$ may be selected at a value greater than 90° thus requiring an inductive matching network coupled to each port of the coupler.

In a preferred construction the pairs of two-port networks are sections of transmission line which extend about a circular locus and the capacitive matching networks each comprise substantially a quadrant section connected to a port of the coupler and disposed on the internal area defined by the circular locus. In other embodiments of the invention the two-port networks may define a square or rectangular shape and the capacitive matching networks may be of square or rectangular shape. Also, lumped elements may be used for the capacitive or inductive matching.

DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
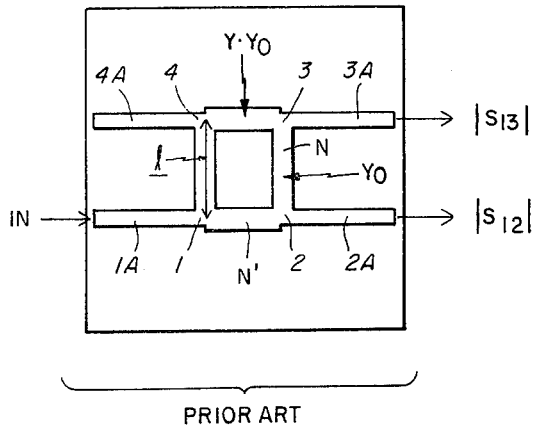
FIG. 1 illustrates a prior art two branch, four port branch line coupler.

FIG. 1 shows a typical prior art branch line directional coupler which comprises four interconnected two-port networks forming the ports 1, 2, 3, and 4 of the coupler. In this embodiment an input signal may be applied to input strip 1A which couples to port 1 while output signals are taken from output strips 2A and 3A coupling respectively from ports 2 and 3 of the coupler. The ports 1 and 4 and the ports 2 and 3 are connected by a two-port network forming transmission line N whereas the ports 1 and 2 and the ports 3 and 4 are connected by a different two-port network (line) N'.

In designing the conventional network of FIG. 1 the line lengths 1 of each network are usually chosen to be of equal length and inversely relate to the operating frequency of the device. The following equation relates physical line lengths and operating frequency.

$$\theta = (2\pi l/\lambda) \quad (1)$$

where $\theta$ = electrical length, $l$ = physical line length, and $\lambda$ = wavelength at the operating frequency.

Normally, the electrical length is 90° at the frequency of perfect match for the two branch case, and it can be seen from equation (1) that at the lower microwave frequencies where the operating wavelength is increasing the physical line lengths are also increased in accordance with known design techniques. However, these increased line lengths require a relatively large device up to even as much as 100 sq. inches in area for the construction of devices operating at relatively low microwave frequencies or UHF frequencies down to 100 MHz.

From our previous application Ser. No. 766,431 the following relationship was found to hold for a branch line directional coupler with two branches.

$$\left| \frac{S_{12}}{S_{13}} \right|^2 = Y^2 - 1 \tag{2}$$

where $S_{12}$ is the amplitude of the signal transmitted to port 2 from port 1; $S_{13}$ is the amplitude of the signal transmitted to port 3 from port 1; and Y is the admittance level ratio between the transmission line sections N and N'. For a quadrature hybrid which is the embodiment of the invention shown in FIGS. 2 and 3, the admittance level ratio Y is equal to $\sqrt{2}$.

From my copending application Ser. No. 766,431 the following general relationship holds for the equivalent admittance for a four port, two branch coupler.

$$Y_{eq} = \frac{Y_o\sqrt{Y^2 - 1}}{\sin\theta} - j(1 + Y)Y_o \cot\theta \tag{3}$$

where Y = admittance level ratio; $Y_o$ = branch line admittance level as shown in FIG. 1; and $\theta$ = electrical length.

For a quadrature hybrid where Y equals $\sqrt{2}$, equation 3 then reduces to the following relationship.

$$Y_{eq} = \frac{Y_o}{\sin\theta} - j(1 + \sqrt{2})Y_o \cot\theta \tag{4}$$

In normal design procedures the electrical length $\theta$ is $\pi/2$ and the branch line admittance level is selected at unity to provide a perfect match. Consequently, the line length $l$ is determined from equation (1) and is a fixed value once the operating frequency is selected. The equivalent admittance has only a real part which is equal to unity. However, in accordance with the present invention by providing appropriate matching networks at each of the ports of the device the structure can be made to operate at a smaller branch line electrical length which in turn means that the device can be constructed in a much smaller size. This is particularly important at the lower end of the microwave spectrum and even down to UHF frequencies where the devices tend to become quite large.

By way of example and in accordance with the invention, the branch line electrical length $\theta$ may be selected at 45° rather than the conventional 90°. This means that there will be halving of the line lengths for the same operating frequency with an attendant reduction of junction area by a factor of 4 as seen from equation (1). Considering equation (4), the real part of the equivalent admittance equals $\sqrt{2}\,Y_o$. If the conductance is to be set at unity then the branch line admittance level $Y_o = 1/\sqrt{2}$.

Because $\theta$ has been chosen at a value less than 90° there is now an imaginary term in equation (4) in the form of an inductive susceptance $-j(1 + \sqrt{2})/\sqrt{2}$. This inductive mismatch is easily compensated for by using a capacitive network at each junction of the device in order to make the total susceptance equal to zero so that the device is matched for $\theta = \pi/4$.

Figure 2:
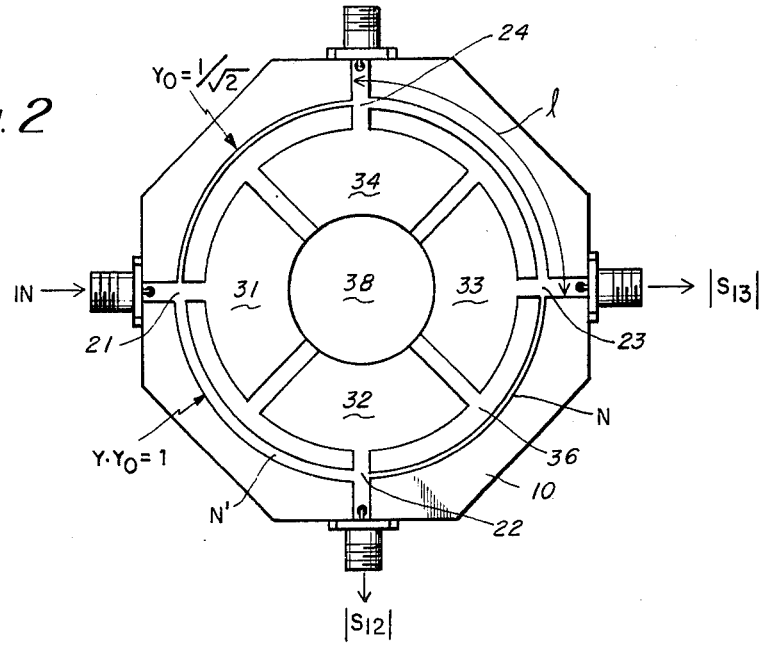
FIG. 2 shows a two branch, four port directional coupler constructed in accordance with the principles of this invention.
Figure 3:
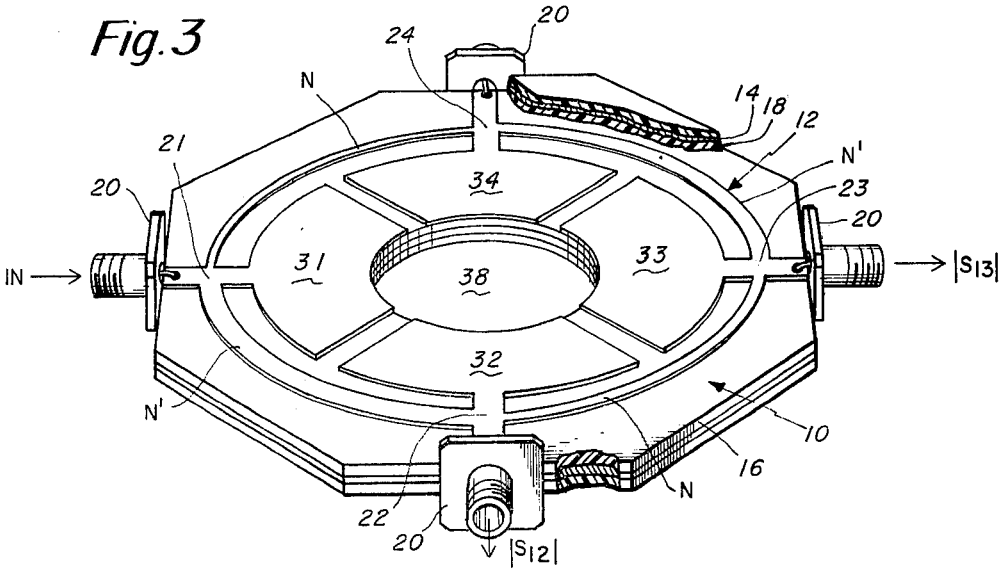
FIG. 3 is a perspective view of a complete device constructed in accordance with the principles of this invention and partially in cross-section.

FIGS. 2 and 3 show a preferred form of the invention in stripline construction. The device is constructed in layers and the layers are interconnected in a suitable manner. The stripline device is primarily embodied on a printed circuit board 10 having clad thereto the conductor 12 which is constructed in a form most clearly shown in FIG. 2. The device also comprises in a sandwich construction ground planes 14 and 16 and a blank insulating sheet 18. Standard connectors 20 are shown in FIG. 3 for making connections at the appropriate ports of the device. In this embodiment the input port is port 21 and the two output ports are ports 22 and 23. Port 24 may have a conventional termination coupled to its connector 20.

The stripline transmission line sections N and N' shown in FIGS. 2 and 3 extend along a circular locus in a preferred construction. For a quadrature hybrid coupler the ratios of the admittances for the networks N and N' are $\sqrt{2}/2$ to 1.0. These different admittance levels are depicted in the drawings by virtue of the transmission line section N being of narrower construction than the section N'.

In order to provide the proper matching in accordance with the invention capacitive plates 31, 32, 33, and 34 are provided associated with each of the ports 21, 22, 23, and 24, respectively. These capacitive plates are disposed in the previously vacant center area 36 defined between the sections N and N'.

Each of the capacitive sections 31–34 is isolated from its adjacent section as depicted in FIG. 2. Further, a central aperture 38 is provided through the substrate 10. The diameter of the aperture 38 may be adjusted for the purpose of trimming the surface area of the capacitive sections for fine tuning to the desired operating frequency.

The capacitance of each of the capacitance plates shown in FIG. 2 is selected to balance the inductive mismatch so that there is essentially zero susceptance at each port of the device. With the capacitance and operating frequency being a direct function of the equivalent admittance from equation (4) the following relationship holds.

$$C\omega = (1 + \sqrt{2})\,Y_o \cot\theta \tag{5}$$

where C = capacitance of each capacitance section, $Y_o$ = branch line admittance level of section N, and $\theta$ = 45°.

In equation (5) the variables $\theta$ and $Y_o$ are known and thus for a predetermined operating frequency $\omega$ the capacitance C can be calculated. With the capacitance known and also knowing the dielectric constant of the substrate material and the spacing from the capacitance sections to the ground plane, one can calculate the area of each of the capacitive plates 31–34. As previously mentioned further trimming of the area of these plates is possible by controlling the size of the aperture 38 in the substrate 10.

In one embodiment of the invention constructed in the form shown in FIGS. 2 and 3, the device is for operation about a center frequency of 500MHz. For this operating frequency the width of substrate 10 between any two parallel edges may be on the order of 2½ inches.

In accordance with the prior art technique of design without the use of matching networks a device of this size is capable of operation at a frequency of about 1000MHz.

Figure 4:
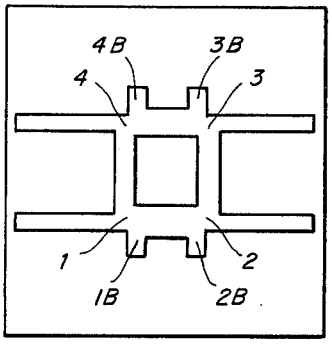
FIG. 4 illustrates an alternate embodiment of the invention with matching stub networks at each port of the coupler.

In addition to providing a more compact construction, the principles of this invention may also be applied in providing a relatively easy means for fine tuning a coupler. Thus, in the embodiment of the invention shown in FIG. 4 the directional coupler is provided with matcing networks 1B, 2B, 3B and 4B coupled respectively to the ports 1, 2, 3, and 4 of the device. For example, if the device is supposed to operate at 4GHz but with the particular matching networks the operation is at the center frequency of 3.9GHz, then the lengths of each of the stub matching networks 1B–4B can be shortened slightly so as to tune the overall device to the desired center operating frequency of 4GHz.

There may also be instances where it may be desirable to use the principles of the present invention for providing a larger device. Thus, at high microwave frequencies where the devices generally become quite small it may be desirable to make the device physically larger so as it will be easier to hold certain dimensional tolerances and it will make it easier for trimming purposes. To make the device larger $\theta$ is selected at a value greater than 90° thereby creating a capacitive mismatch which must then be balanced by an inductive matching network rather than the capacitive networks shown in FIG. 2. This inductive network may simply be a lumped element inductor having one end coupled to each port of the device and having its other end grounded to the ground plane. The inductor may also be a length of transmission line (stub) which is short circuited having an electrical length slightly shorter than 90°.

Figure 5:
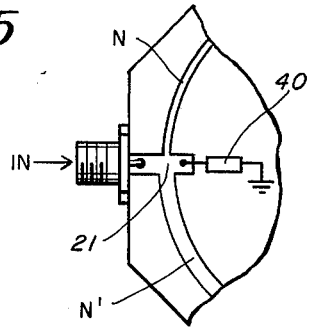
FIG. 5 is a fragmentary view of an alternate embodiment using a lumped element matching network.

FIG. 5 is a fragmentary view showing a device like the device shown in FIGS. 2 and 3 with the capacitive plate replaced by a reactive lumped element 40. In the preferred embodiment of the invention wherein it is desired to make the device more compact the reactive element 40 is a capacitive element or may be a voltage tunable varactor diode and can be quite easily adjusted to obtain the proper operating frequency. In the alternate embodiment of the invention mentioned herein, the element 40 may also be an inductive lumped element. When the lumped element version is used there is a lumped element matching network coupled to each port of the device.

Having described one embodiment of the present invention, it should now become apparent to those skilled in the art that numerous other embodiments of the invention can be constructed. For example, the capacitive plates shown in FIG. 2 for some applications may be replaced by lumped element capacitors while still maintaining the size reduction. Also, the device of this invention can be constructed in many different forms such as in a square form with each of the capacitance plates also having a square shape. One important feature of the present invention is that the miniaturization procedure described above does not significantly effect the bandwidth of the junction which still remains about 10% for a 20db return loss.

What is claimed is:

1. A directional coupler comprising four sections of signal transmission line interconnected so as to form at the junctions therebetween four ports of the coupler, the improvement comprising a reactive matching element connected to each port of the coupler, said sections of transmission line defining an open interior area within which the reactive matching elements are disposed to thereby minimize the overall area covered by the coupler.

2. A directional coupler as set forth in claim 1 wherein each section of signal transmission line is of strip line construction.

3. A directional coupler as set forth in claim 1 wherein each section of signal transmission line is of microstrip construction.

4. A directional coupler as set forth in claim 1 wherein the reactive matching element is inductive, the electrical line length of each section of signal transmission line being selected at $\theta > 90°$ so that the physical line lengths are increased for a predetermined operating frequency.

5. A directional coupler as set forth in claim 1 wherein said coupler is symmetrical.

6. A directional coupler as set forth in claim 1 wherein the sections of transmission line have like electrical length.

7. A directional coupler as set forth in claim 1 wherein each reactive matching network includes a stub strip extending from each port, the length of the stub strip being trimmable to obtain the desired operating frequency of the coupler.

8. A directional coupler as set forth in claim 1 wherein the reactive element is capacitive, the electrical line length of each section of signal transmission line being selected at $\theta > 90°$ so that the physical line lengths are reduced for a predetermined operating frequency.

9. A directional coupler as set forth in claim 8 wherein the capacitive matching element includes a conductive strip disposed in the area defined by the transmission line sections.

10. A directional coupler as set forth in claim 9 wherein each conductive strip is substantially a quadrant of a circle.

11. A directional coupler as set forth in claim 9 wherein said sections of signal transmission line are disposed along a substantially circular locus having a center aperture the diameter of which is adjustable to trim the conductive strips.

12. A directional coupler as set forth in claim 1 wherein said reactive matching element includes a lumped element means.

13. A directional coupler as set forth in claim 12 wherein the lumped element means includes an inductive lumped element.

14. A directional coupler as set forth in claim 12 wherein the lumped element means include a capacitive lumped element.

15. A directional coupler as set forth in claim 14 wherein the capacitive lumped element includes a controllable varactor.

* * * * *

UNITED STATES PATENT OFFICE

CERTIFICATE OF CORRECTION

Patent No. 4,127,832 Dated November 28, 1978

Inventor(s) Gordon P. Riblet

It is certified that error appears in the above-identified patent and that said Letters Patent are hereby corrected as shown below:

Claim 8, line 4 change "$\theta>90°$" to -- $\theta<90°$ --.

Signed and Sealed this

*Fifteenth* Day of *April 1980*

[SEAL]

*Attest:*

SIDNEY A. DIAMOND

*Attesting Officer*

*Commissioner of Patents and Trademarks*